United States Patent [19]

Sakurai et al.

[11] 4,275,278

[45] Jun. 23, 1981

[54] DIAPHRAGM FOR A LOUDSPEAKER

[75] Inventors: Sadaaki Sakurai, Yokohama; Mitsuru Takashima; Masana Ugaji, both of Tokyo, all of Japan

[73] Assignee: Sony Corporation, Tokyo, Japan

[21] Appl. No.: 67,222

[22] Filed: Aug. 17, 1979

[30] Foreign Application Priority Data

Aug. 18, 1978 [JP] Japan ..... 53-100003

[51] Int. Cl.[3] ..... H04R 7/02; H04R 9/02

[52] U.S. Cl. ..... 179/181 F; 179/115.5 R; 181/166; 181/170

[58] Field of Search ..... 181/157, 166, 167, 170, 181/171, 172, 173, 174; 179/181 R, 181 F, 115.5 R, 115.5 ES

[56] References Cited

U.S. PATENT DOCUMENTS

Re. 17,086 9/1928 Kolster et al. ..... 181/166

3,153,463 10/1964 Novak ..... 179/181 R 4,163,876 8/1979 Ohnuki ..... 179/115.5 R

FOREIGN PATENT DOCUMENTS 1518285 7/1978 United Kingdom ..... 181/170

*Primary Examiner*—Thomas A. Robinson

*Attorney, Agent, or Firm*—Lewis H. Eslinger; Alvin Sinderbrand

[57] ABSTRACT

A diaphragm for a loudspeaker includes a core member having a flat front surface from which a frustum-shaped side surface extends to a back portion, a cover member secured to the back portion and adapted to be connected to a voice coil bobbin of the loudspeaker, an outer radiation layer mounted on the front surface and having a relatively high resonance sharpness, and an intermediate layer laminated between the front surface and the outer radiation layer and having a resonance sharpness lower than that of the outer radiation layer.

16 Claims, 7 Drawing Figures

DIAPHRAGM FOR A LOUDSPEAKER

BACKGROUND OF THE INVENTION

This invention relates generally to a diaphragm for a loudspeaker and, more particularly, to a loudspeaker diaphragm provided with a core member which is made from a foamed resin material molded into a frustum configuration.

Diaphragms for use in loudspeakers are known in which a foamed resin material, such as foaming polystyrene, is molded generally into a frusto-conical configuration to be used for the core member of the diaphragm. Such diaphragms typically have the same mass as conventional diaphragms of paper and the like which are also molded into a frusto-conical configuration.

Although these foamed core members provided certain advantages over conventional paper core members, for example, hindering the formation of a split vibration and improving the acoustic characteristics thereof, they disadvantageously have a low vibration or acoustic propagation speed and a relatively low natural resonance frequency, while retaining a high resonance sharpness Q. Thus, the acoustic output-frequency characteristic of the foamed diaphragms have a remarkable peak dip, particularly in the high-pitched tone region, and do not establish a satisfactory flat response.

The foamed diaphragm usually has its back or small-diameter portion connected to a voice coil bobbin and is driven thereby. However, the distance between the back or small-diameter end portion and the flat front surface of the frustum at its center differs from the distance between the back portion and the front surface at the periphery of the latter, resulting in a degradation of the phase characteristic of the acoustic output. Further, since the voice coil bobbin is adhesively affixed directly to the back end of the foamed core member, it is difficult to maintain the bobbin in a fixed condition with any satisfactory degree of accuracy, and the resulting movement with respect to the adhesively fixed condition affects the acoustic output-frequency characteristic in the high-pitched tone region.

Furthermore, since the foamed resin material has a generally poor heat resistance, it is difficult to use such material in a diaphragm of a large output speaker because of the large amount of heat transferred from the bobbin to the core member.

OBJECTS AND SUMMARY OF THE INVENTION

Accordingly, it is an object of this invention to provide a diaphragm for a loudspeaker that avoids the above-described difficulties encountered with the prior art.

More particularly, it is an object of this invention to provide a diaphragm for a loudspeaker which is constructed to give a substantially flat response to the acoustic output-frequency characteristic in the high-pitched tone region.

It is another object of this invention to provide a diaphragm for a loudspeaker which reduces the peak dip of the acoustic output-frequency characteristic in the high-pitched tone region.

It is a further object of this invention to provide a diaphragm for a loudspeaker which maintains the voice coil bobbin and core member of the diaphragm in an accurately aligned and securely coupled condition.

It is still a further object of this invention to provide a diaphragm for a loudspeaker with improved heat resistant properties for application to large output loudspeakers.

In accordance with an aspect of this invention, a diaphragm for a loudspeaker comprises a frustum-shaped core member having a flat front surface, an outer radiation layer mounted on the front surface and having a high resonance sharpness, and an intermediate layer interposed between the front core surface and the outer radiation layer and having a resonance sharpness lower than that of the outer radiation layer. Further, the core member has an exterior surface which tapers from its front surface to the back end portion of the core member, and the diaphragm further includes a cover member connected to the back portion and adapted to be connected to the voice coil bobbin of the loudspeaker.

The above, and other, objects, features and advantages of the invention, will be apparent in the following detailed description of the illustrative embodiment of the invention which is to be read in connection with the accompanying drawings.

DETAILED DESCRIPTION OF THE PREFERRED EMBODIMENT

Figure 1:
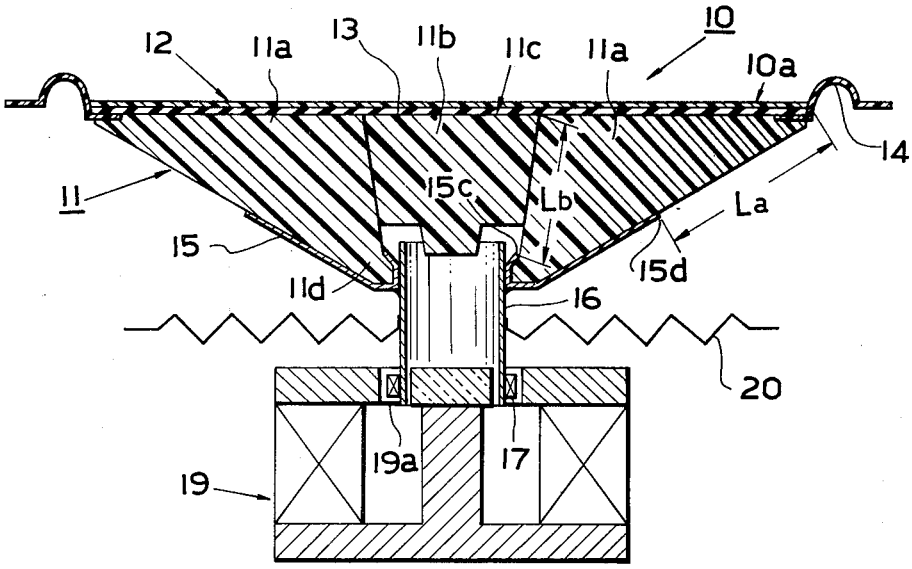
FIG. 1 is a cross-sectional view of a diaphragm for a loudspeaker according to an embodiment of this invention.

Referring to the drawings in detail, and initially to FIG. 1 thereof, a diaphragm 10 for a loudspeaker according to an embodiment of this invention is shown to be comprised of a core member 11 molded generally into a frustum or frusto-conical configuration, an outer radiation layer 12 having a relatively high resonance sharpness Q and an intermediate layer 13 interposed between core member 11 and outer radiation layer 12 and having a resonance sharpness Q lower than that of the outer radiation layer 12. Preferably, core member 11 is composed of a foamed resin material, such as foamed polystyrene or the like, outer radiation layer 12 is made from a sheet of polyester, vinyl chloride or the like, having an approximate thickness of 100 μm, and intermediate layer 13 is composed of foamed butyl rubber, sponge or like material, having a thickness of approximately 1 mm.

Figure 2:
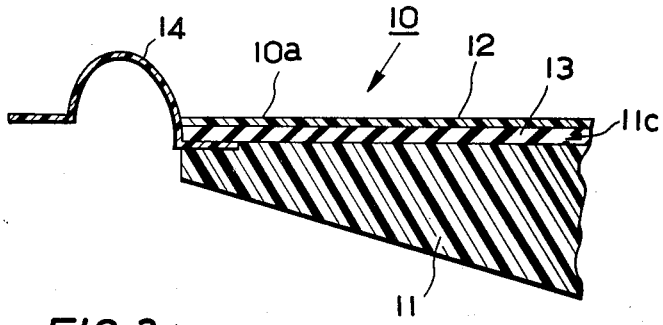
FIG. 2 an enlarged fragmentary cross-sectional view of a peripheral portion of the diaphragm of FIG. 1, and showing details of the attachment of an edge member attached thereto.

As shown in FIG. 1, core member 11 is divided into two sections, that is, a peripheral or outer section 11*a* having a central hollow portion into which there is fitted a center section 11*b*, in order that the diaphragm may be more easily produced. Sections 11*a* and 11*b* are integrated with each other such that center section 11*b* conforms in shape to the central hollow portion of peripheral section 11*a* and such that the sections together form a continuous flat front surface 11*c* which has intermediate layer 13 and outer radiation layer 12 laminated thereon. An edge member 14 may be connected to diaphragm 10 by sandwiching a portion thereof between intermediate layer 13 and surface 11*c*, as shown in FIG. 2.

Figure 3:
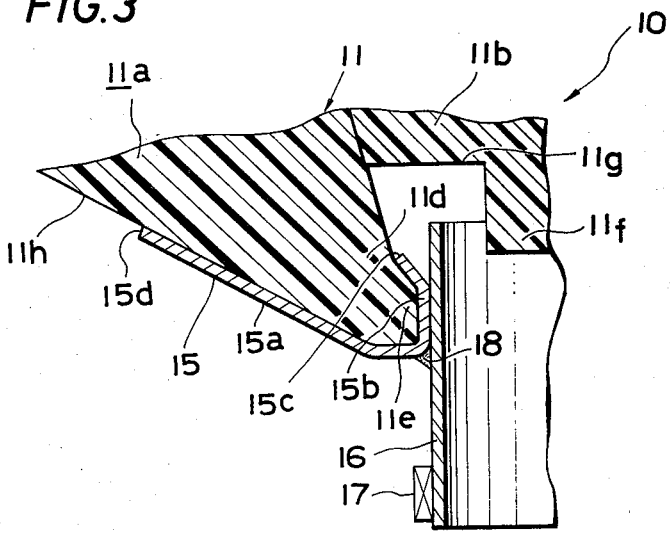
FIG. 3 is an enlarged fragmentary cross-sectional view of a back end portion of the diaphragm of FIG. 1, and particularly showing its connection to the voice coil bobbin of the loudspeaker.

Referring to FIG. 3, it will be seen that peripheral section 11*a* is formed, at its back end portion 11*d*, with a circumferential flange 11*e* which projects inwardly, and center section 11*b* is stepped at its back end 11*f* so as to form a circumferential or annular stepped or cut-out portion 11*g* in communication with the central hollow portion of peripheral section 1*a*.

Further, diaphragm 10 includes a cover member 15 of a unitary or laminated lightweight, rigid material, for example, a punched metal or mesh material, such as, aluminum, magnesium, titanium, beryllium, boron, or the like, which covers an area of back portion 11*d* of core member 11. Cover member 15 is shown to be comprised of a first flaring portion 15*a* adhesively secured to, and covering the peripheral tapered surface of core member 11 and a second cylindrical portion 15*b* shaped to extend closely through the hole defined by circumferential flange 11*e*. The free edge portion 15*c* of cylindrical portion 15*b* is outwardly swaged, as shown, to embrace flange 11*e* and thereby further secure cover member 15 to core member 11. As shown in FIG. 1, the distance La between the edge 15*d* of first portion 15*a* and the peripheral edge of the acoustic output or radiation surface 10*a* of the diaphragm, that is, of outer radiation layer 12, is approximately equal to the distance Lb between the edge 15*c* of second portion 15*b* and continuous front surface 11*c* of core member 11, taken along the inner surface of peripheral section 11*a*, in order that a satisfactory phase characteristic can be obtained for the diaphragm.

Diaphragm 10 is provided with a voice coil bobbin 16 wound with a voice coil 17 of the same type used in conventional loudspeakers, and one end of voice coil bobbin 16 is inserted into a recess defined by cylindrical portion 15*b* of cover member 15, the inner surface of peripheral section 11*a* and the stepped or cut-out portion 11*g* of center section 11*b*, and is fixedly secured to cover member 15 by a suitable adhesive, as at 18. In constructing the diaphragm, it is preferable and more efficient to adhere voice coil bobbin 16 to cover member 15 before center section 11*b* is inserted into and integrated with peripheral section 11*a* of the core 11.

As shown in FIG. 1, the loudspeaker is further supplied with a magnetic circuit 19 having a magnetic gap 19*a* in which voice coil 17 is disposed, whereby diaphragm 10 is driven by electric input signals applied to voice coil 17. The location of voice coil bobbin 16 is regulated by a damper member 20, which is secured to a frame (not shown), along with edge member 14 and magnetic circuit 19.

In the above-described embodiment of this invention, the split vibration frequency of the primary mode of core member 11 can be raised to a higher frequency by mounting thereon the outer radiation layer 12 which has a relatively high resonance sharpness Q. Further, the resonance sharpness Q of core member 11 can be reduced by mounting intermediate layer 13 between continuous surface 11*c* and layer 12, with such intermediate layer 13 having a resonance sharpness Q lower than that of outer radiation layer 12 so as to provide a desired internal loss. By reason of the foregoing, a relatively flat response is obtained by reducing the peak dip of the acoustic output-frequency characteristic, particularly in the high-pitched tone region.

Figure 4A:
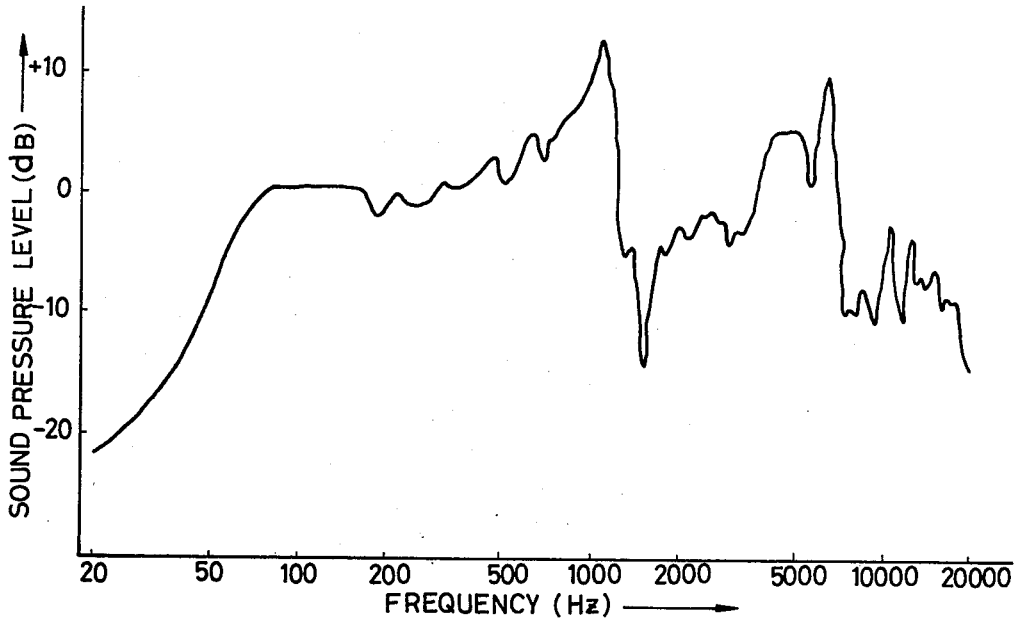
FIG. 4A is a graphical representation of the acoustic output-frequency characteristic of a conventional diaphragm.
Figure 4B:
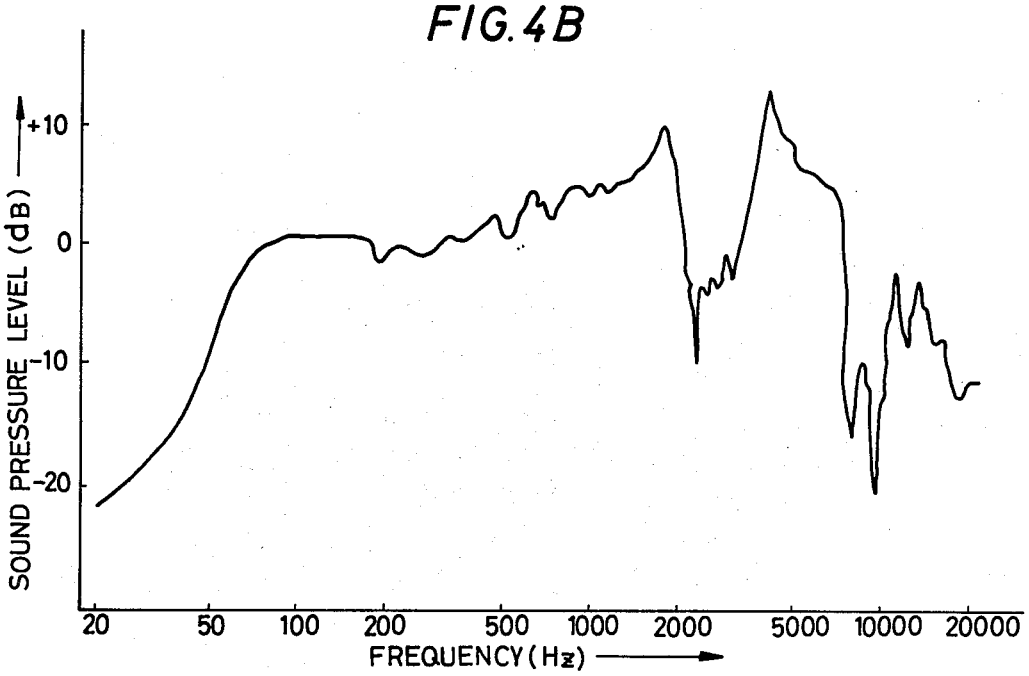
FIG. 4B is a graphical representation similar to that of FIG. 4A, but illustrating the acoustic output-frequency characteristic of a conventional diaphragm having an outer radiation layer.

More particularly, the acoustic output-frequency characteristic of a loudspeaker using a conventional diaphragm is shown in FIG. 4A. There is some improvement in the acoustic output-frequency characteristic of a diaphragm when only an outer radiation ayer 12 of a vinyl chloride material is adhered to the surface 11*c* of core member 11 (without the intermediate layer 13). Such improvement is realized particularly in respect to the rise in the split vibration frequency of the primary mode and a slight reduction in the peak dip of the acoustic output-frequency characteristic, as shown in FIG. 4B. However, with the addition of outer skin layer 12 alone, a sufficiently flat response is still not obtained. Further, alteration of the thickness and material of outer radiation layer 12 may have an undesired effect on the adhesive property of the core member without bringing about an effective change in the acoustic output-frequency characteristic.

In the embodiment of the diaphragm according to this invention, in which intermediate layer 13 is made from a butyl rubber sheet with a resonance sharpness Q less than one-fifth of that of outer radiation layer 12 and is interposed between core member 11 and outer radiation layer 12, the acoustic output-frequency characteristic is substantially improved or flattened, particularly in the high-pitched tone region from 1 KHz to 5 KHz. It has been found that, by proper selection of the materials and properties of outer radiation layer 12 and intermediate layer 13, the acoustic output-frequency characteristic can be controlled over a wide range thereof. On the other hand, it has been found that the type of adhesive used for connecting outer radiation layer 12, intermediate layer 13, and core member 11 does not have a major effect on the acoustic output-frequency characteristic of the loudspeaker.

Figure 4C:
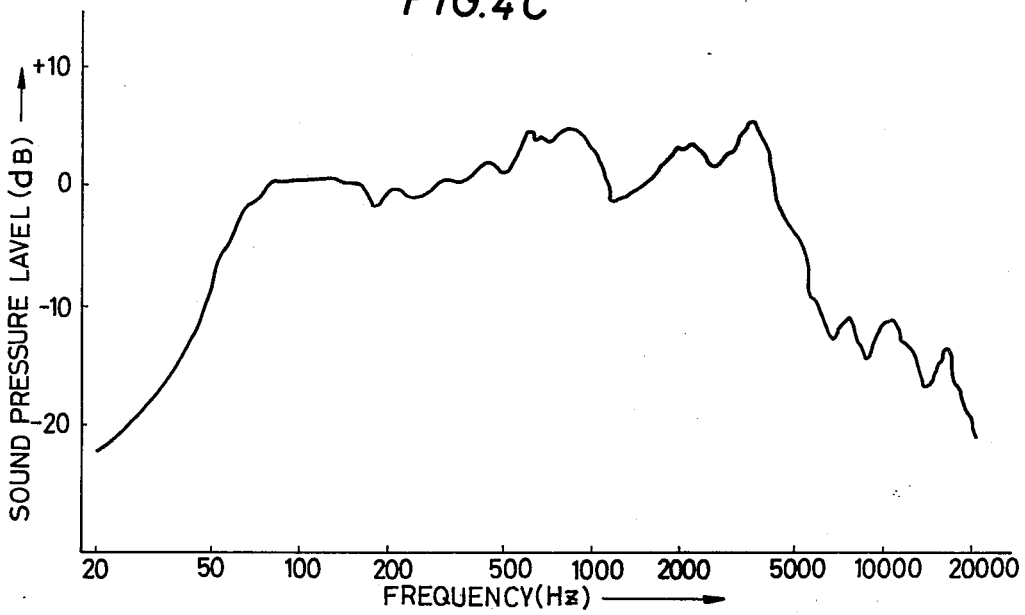
FIG. 4C is a graphical representation illustrating the acoustic output-frequency characteristic of a diaphragm according to an embodiment of this invention.

The diaphragms which are the subject of the characteristics shown on FIGS. 4A to 4C each had a cover member 15 secured to the core member of each diaphragm. It is to be noted that, with voice coil bobbin 16 adhesively fixed to cover member 15, the accuracy of alignment and connection of bobbin 16 to the diaphragm is improved so as to provide a diaphragm with a more uniform acoustic output-frequency characteristic than is obtained when bobbin 16 is directly adhered to the foamed resin material of core member 11. Further, since heat produced in voice coil 17 can be radiated from diaphragm 10 through cover member 15 adhered to core member 11, the heat resistance is improved so as to permit production of a large acoustic output. Also, since core member 11 is made from a foamed resin material and is driven through cover member 15, which is made of a light and rigid material, any adverse effect on the acoustic output-frequency characteristic caused by the natural vibrations of core member 11, can be reduced. Further, since the previously described distances La and Lb are made to be approximately equal, the acoustic subject of the diaphragm can be provided with a satisfactory phase characteristic.

Figure 4D:
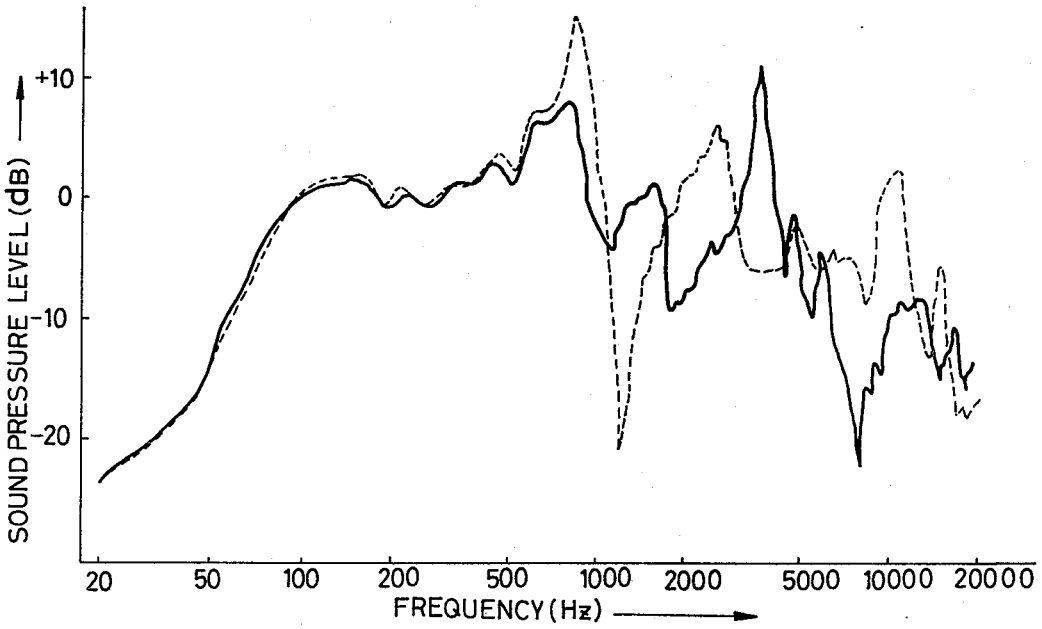
FIG. 4D is a graphical representation, comparing the acoustic output-frequency characteristic of a conventional diaphragm with that of a similar diaphragm having a cover member.

As shown in the acoustic output-frequency graph FIG. 4D, the use of cover member 15 can effectively raise the resonance frequency in the high-pitched tone region by about 3000 Hz, while, at the same, reducing the peak dip in the same region to provide a relatively more satisfactory acoustic output-frequency characteristic. In FIG. 4D, the broken line illustrates the characteristic of a conventional diaphragm having a core member 11 of foaming polystyrene directly connected to bobbin 16, and the solid line illustrates the characteristic of the same diaphragm merely provided with cover member 15. In other words, both diaphragms represented by FIG. 4D do not have outer radiation layer 12 and intermediate layer 13 laminated thereon. Therefore, FIG. 4D shows only the effect of cover member 15.

Having described a specific embodiment of the invention with reference to the accompanying drawings, it is to be understood that the invention is not limited to that precise embodiment, and that various changes and modifications may be effected therein by one skilled in the art without departing from the scope or spirit of the invention as defined in the appended claims.

What is claimed is:

1. A diaphragm for a loudspeaker comprising:

a frustum-shaped core member having a front surface;

an outer radiation layer mounted on said front surface and having a high resonance sharpness; and an intermediate layer interposed between said front surface and said outer radiation layer, and having a resonance sharpness lower than that of said outer radiation layer.

2. A diaphragm according to claim 1; further comprising an edge member for connecting said core member to a loudspeaker frame, said edge member having a portion thereof connected to said diaphragm by being interposed between said front surface and said intermediate layer.

3. A diaphragm according to claim 1; in which said intermediate layer is of foamed butyl rubber.

4. A diaphragm according to claim 1; in which said outer radiation layer is of polyester.

5. A diaphragm for a loudspeaker comprising:

a frustum-shaped core member having a front surface, a first peripheral section having a central hollow portion and a tapered exterior surface, and a second center section which conforms in shape to said central hollow portion, said sections being integrated with each other so as to form said front surface;

an outer radiation layer mounted on said front surface and having a high resonance sharpness; and an intermediate layer interposed between said front surface and said outer radiation layer, and having a resonance sharpness lower than that of said outer radiation layer.

6. A diaphragm according to claim 5; in which said first section includes an inwardly directed flange and said second section includes a cut-out portion in communication with said central hollow portion.

7. A diaphragm according to claim 6; further comprising a cover member connected to said first peripheral section and covering said flange and a portion of said tapered exterior surface.

8. A diaphragm for a loudspeaker according to claim 7; in which said loudspeaker includes a voice coil bobbin connected to said cover member.

9. A diaphragm according to claim 8; in which said core member has a recess therein defined by said cover member, said central hollow portion and said cut-out portion, and said bobbin is disposed within said recess.

10. A diaphragm according to claim 7; in which said cover member has a first edge at its connection to said flange member and a second edge along said exterior tapered surface, and the distance from said first edge to said front surface, at the mating of said peripheral section with said center section, is substantially equal to the distance from said second edge to a peripheral edge of said outer radiation layer.

11. A diaphragm for a loudspeaker comprising:

a frustum-shaped core member having a front surface and an exterior surface which tapers from said front surface to a back portion of said core member;

a cover member connected to said back portion of said core member and adapted to be connected to a voice coil bobbin of said loudspeaker;

an outer radiation layer mounted on said front surface and having a high resonance sharpness; and an intermediate layer interposed between said front surface and said outer radiation layer, and having a resonance sharpness lower than that of said outer radiation layer.

12. A diaphragm for a loudspeaker comprising:

a frustum-shaped core member having a front surface and a back portion; and a cover member connected to said back portion of said core member and adapted to be connected to a voice coil bobbin of said loudspeaker.

13. A diaphragm for a loudspeaker comprising:

a frustum-shaped core member having a front surface, a back portion, a first peripheral section having a central hollow portion and a tapered exterior surface, and a second center section which conforms in shape to said central hollow portion; and a cover member connected to said back portion of said core member and adapted to be connected to a voice coil bobbin of said loudspeaker.

14. A diaphragm according to claim 13; in which said first section includes an inwardly directed flange member of said back portion, and said second section includes a cut-out portion in communication with said central hollow portion.

15. A diaphragm according to claim 14; in which said cover member is connected to said first peripheral section and covers said flange member and a portion of said tapered exterior surface.

16. A diaphragm according to claim 15; in which said core member includes a front surface; and in which said cover member has a first edge at its connection to said flange member and a second edge along said exterior tapered surface, and the distance from said first edge to said front surface, at the mating of said peripheral section and said center section, is substantially equal to the distance from said second edge to a peripheral edge of said outer radiation layer.

* * * * *